US010544990B2

(12) United States Patent
Yoo et al.

(10) Patent No.: US 10,544,990 B2
(45) Date of Patent: Jan. 28, 2020

(54) HEAT EXCHANGER

(71) Applicant: LG ELECTRONICS INC., Seoul (KR)

(72) Inventors: Sanghoon Yoo, Seoul (KR); Taegyun Park, Seoul (KR); Juhyok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 118 days.

(21) Appl. No.: 15/223,253

(22) Filed: Jul. 29, 2016

(65) Prior Publication Data

US 2017/0030650 A1 Feb. 2, 2017

(30) Foreign Application Priority Data

Jul. 31, 2015 (KR) ..... 10-2015-0108931

(51) Int. Cl.
*F28D 1/04* (2006.01)
*F28D 1/053* (2006.01)
(Continued)

(52) U.S. Cl.
CPC ..... *F28D 1/0435* (2013.01); *F28D 1/0417* (2013.01); *F28D 1/0452* (2013.01);
(Continued)

(58) Field of Classification Search
CPC .... F28D 1/0435; F28D 1/0452; F28D 1/0417; F28D 1/05391; F28F 9/0273; F28F 2009/222
(Continued)

(56) References Cited

U.S. PATENT DOCUMENTS 5,251,693 A * 10/1993 Zifferer ..... F28D 7/0041 165/160
5,529,116 A * 6/1996 Sasaki ..... F28D 1/0417 123/41.51
(Continued)

FOREIGN PATENT DOCUMENTS

JP 03084395 A * 4/1991 ..... F28D 1/0417
JP 03084395 A * 4/1991 ..... F28D 1/0417
(Continued)

OTHER PUBLICATIONS

KR20130103915A English Machine Translation—Retrieved Jan. 2018.*
(Continued)

*Primary Examiner* — Cassey D Bauer
*Assistant Examiner* — Jenna M Hopkins
(74) *Attorney, Agent, or Firm* — Ked & Associates LLP

(57) ABSTRACT

A microchannel type heat exchanger may include a first heat exchanger and a second heat exchanger, in which a plurality of flat tube may be provided, a first path defined in flat tubes provided in the first heat exchanger, in which refrigerant flows in a first direction, a second path defined in flat tubes provided in the first heat exchanger, in which refrigerant, from the first path, flows in a second direction opposite to the first direction, a third path defined in the flat tubes provided in the first heat exchanger and a portion of the flat tubes provided in the second heat exchanger, in which refrigerant, from the second path, flows in a third direction opposite to the second direction, and a fourth path defined in the flat tubes provided in the second heat exchanger, in which refrigerant, from the third path, flows in a fourth direction opposite to the third direction.

11 Claims, 6 Drawing Sheets

(51) Int. Cl.
*F28F 9/02* (2006.01)
*F28F 9/22* (2006.01)

(52) U.S. Cl.
CPC ..... *F28D 1/05391* (2013.01); *F28F 9/0273* (2013.01); *F28F 2009/222* (2013.01); *F28F 2260/02* (2013.01)

(58) Field of Classification Search
USPC ..... 165/168, 174, 177
See application file for complete search history.

(56) References Cited

U.S. PATENT DOCUMENTS 6,272,881 B1 * 8/2001 Kuroyanagi ..... F28D 1/035 165/153
6,339,937 B1 * 1/2002 Makihara ..... F25B 39/02 62/503
7,051,796 B2 * 5/2006 Kamiyama ..... F28D 1/0443 165/140
7,523,781 B2 * 4/2009 Oh ..... F28D 1/0333 165/153
8,701,750 B2 * 4/2014 Oh ..... F28D 1/05391 165/174
9,377,252 B2 * 6/2016 Garret ..... F28D 7/1684
9,797,656 B2 * 10/2017 Matsumoto ..... F28F 9/0204
2002/0020521 A1 * 2/2002 Hoshino ..... F25B 39/024 165/174
2005/0172664 A1 * 8/2005 Cho ..... F28D 1/05391 62/515
2008/0023185 A1 * 1/2008 Beamer ..... F28D 1/05375 165/174
2008/0053137 A1 * 3/2008 Higashiyama ..... B60H 1/00335 62/324.6
2009/0166017 A1 * 7/2009 Katoh ..... F28D 1/05358 165/153
2011/0198065 A1 * 8/2011 Hanafusa ..... F25B 39/04 165/173
2011/0303401 A1 * 12/2011 Kamoshida ..... B60H 1/00335 165/173
2012/0096894 A1 * 4/2012 Higashiyama ..... F25B 39/02 62/525
2014/0069136 A1 * 3/2014 Lim ..... B60H 1/005 62/434
2014/0124183 A1 * 5/2014 Hwang ..... F25B 39/00 165/173
2014/0144611 A1 * 5/2014 Yoshimura ..... F28F 7/02 165/168
2014/0284035 A1 * 9/2014 Park ..... F28F 9/0273 165/173
2014/0311703 A1 * 10/2014 Takagi ..... F28F 9/0207 165/41
2015/0241129 A1 * 8/2015 Cui ..... F28F 9/0207 165/143
2015/0241131 A1 * 8/2015 Katoh ..... F28D 1/05366 165/140
2016/0003545 A1 * 1/2016 Taras ..... F28F 9/0214 165/143
2017/0074591 A1 * 3/2017 Kim ..... F28F 9/0202
2017/0138675 A1 * 5/2017 Lu ..... F28D 7/0066
2017/0343290 A1 * 11/2017 Jindou ..... F25B 39/022

FOREIGN PATENT DOCUMENTS

JP 2011-257111 12/2011
JP WO 2013145965 A1 * 10/2013 ..... F28F 9/0204
JP WO 2014068842 A1 * 5/2014 ..... F25B 39/028
JP 2014-228240 12/2014
KR 10-2005-0037407 4/2005
KR 10-0765557 10/2007
KR 20130103915 A * 9/2013
KR 1020130103915 A * 9/2013
WO WO 2009061157 A2 * 5/2009 ..... F28D 1/05391
WO WO-2009061157 A2 * 5/2009 ..... F28D 1/05391
WO WO 2009151282 A2 * 12/2009 ..... B60H 1/00335
WO WO-2009151282 A2 * 12/2009 ..... B60H 1/00335
WO WO-2013145965 A1 * 10/2013 ..... F28F 9/0204
WO WO-2014068842 A1 * 5/2014 ..... F25B 39/028

OTHER PUBLICATIONS

A review of development of micro-channel heat exchanger applied in air-conditioning system—Han et al. (2012).*
KR 1020130103915 A English Machine Translation—Retrieved Jan. 2018.*
Korean Office Action dated Dec. 20, 2016.
Korean Notice of Allowance dated Dec. 18, 2017.

* cited by examiner

HEAT EXCHANGER

CROSS-REFERENCE TO RELATED APPLICATION(S)

This application claims priority to Korean Patent Application No. 10-2015-0108931 filed in Korea on Jul. 31, 2015, in the Korean Intellectual Property Office, the disclosure of which is incorporated herein by reference.

BACKGROUND

1. Field

A heat exchanger is disclosed herein.

2. Background

In a refrigeration cycle apparatus including a compressor, a condenser, an expansion valve, and an evaporator, a heat exchanger may generally be used as the condenser or the evaporator. In addition, a heat exchanger may be mounted in a vehicle, or a refrigerator, for example, to perform heat exchange between a refrigerant and air.

Based on a structure thereof, a heat exchanger may be classified as a fin tube type heat exchanger or a microchannel type heat exchanger. The fin tube type heat exchanger is made of a copper material, and the microchannel type heat exchanger is made of an aluminum material.

The microchannel type heat exchanger has microchannels defined therein. As a result, the microchannel type heat exchanger exhibits higher efficiency than the fin tube type heat exchanger.

The fin tube type heat exchanger may be manufactured by welding fins and tubes to each other, with a result that it is possible to easily manufacture the fin tube type heat exchanger. On the other hand, the microchannel type heat exchanger may be manufactured though brazing in a furnace, with a result that an initial investment for manufacturing the microchannel type heat exchanger is high.

In particular, it is easy to configure the fin tube type heat exchanger so as to have a two-row structure as it is possible to easily manufacture the fin tube type heat exchanger. On the other hand, it is difficult to configure the microchannel type heat exchanger so as to have a two-row structure as the microchannel type heat exchanger is manufactured in a furnace.

FIG. 1 is a perspective view of a conventional microchannel type heat exchanger. As shown in FIG. 1, the conventional microchannel type heat exchanger includes a first row 1 and a second row 2. The first row 1 and the second row 2 are connected to each other via a header 3. The header 3 is provided with a channel, through which a refrigerant flows from the first row 1 to the second row 2.

In the conventional two-row microchannel type heat exchanger, a refrigerant introduction port 4 is located at a lower side of the first row 1, and a refrigerant discharge port 5 is located at a lower side of the second row 2. In particular, as shown in FIG. 1, a plurality of introduction ports 4 is provided to supply the refrigerant into the first row 1 through a plurality of channels.

In the first row 1, the refrigerant flows upward. After passing through the header 3, the refrigerant flows downward.

In the conventional microchannel type heat exchanger, only one discharge port 5 is provided. That is, the refrigerant, having passed through the first row 1, is gathered in the second row 2, and is then discharged through the discharge port 5. In a case in which the conventional microchannel type heat exchanger is used as an evaporator, the refrigerant is evaporated while the refrigerant is flowing from the first row 1 to the second row 2, with a result that a pressure of the refrigerant is lost.

An example of such a conventional heat exchanger is disclosed in Korean Registered Patent No. 10-0765557, which is hereby incorporated by reference.

BRIEF DESCRIPTION OF THE DRAWINGS

Embodiments will be described in detail with reference to the following drawings in which like reference numerals refer to like elements, and wherein.

DETAILED DESCRIPTION

Figure 1:
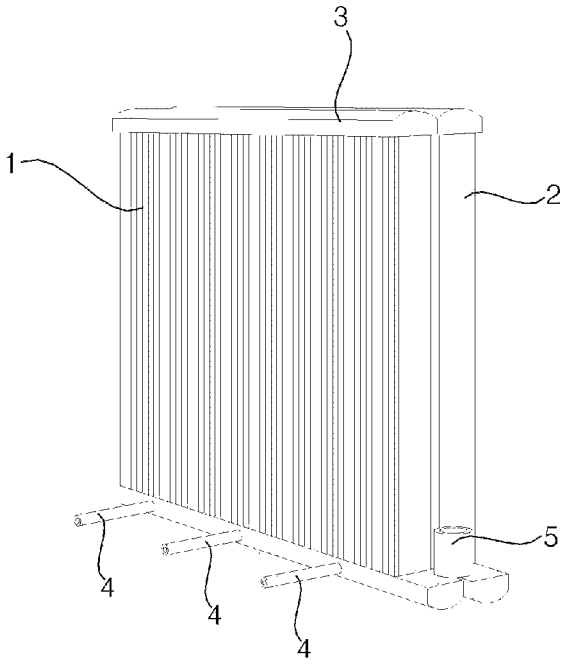
FIG. 1 is a perspective view of a conventional microchannel type heat exchanger.

Embodiments will be described in detail with reference to the accompanying drawings. Where possible, like reference numerals have been used to indicate like elements, and repetitive disclosure has been omitted.

Figure 2:
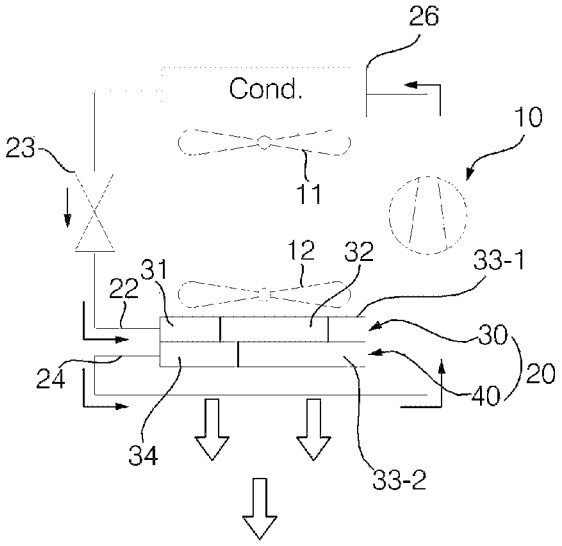
FIG. 2 is a schematic diagram showing an air conditioner including a microchannel type heat exchanger according to an embodiment.
Figure 3:
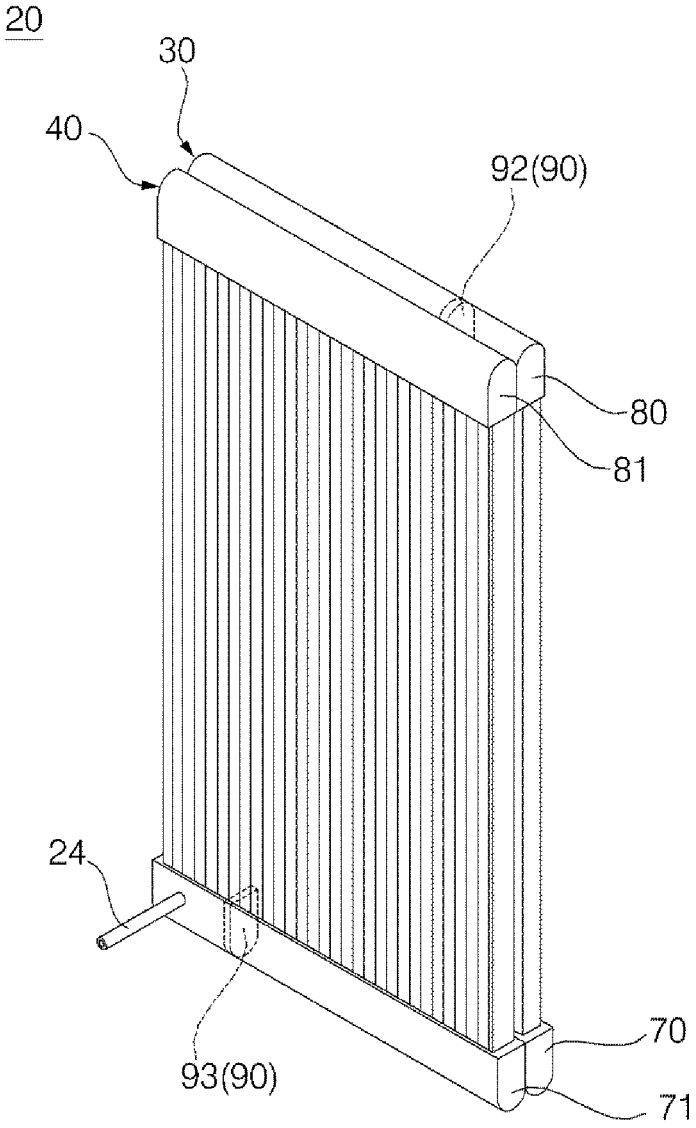
FIG. 3 is a perspective view of an evaporation heat exchanger shown in FIG. 2.
Figure 4:
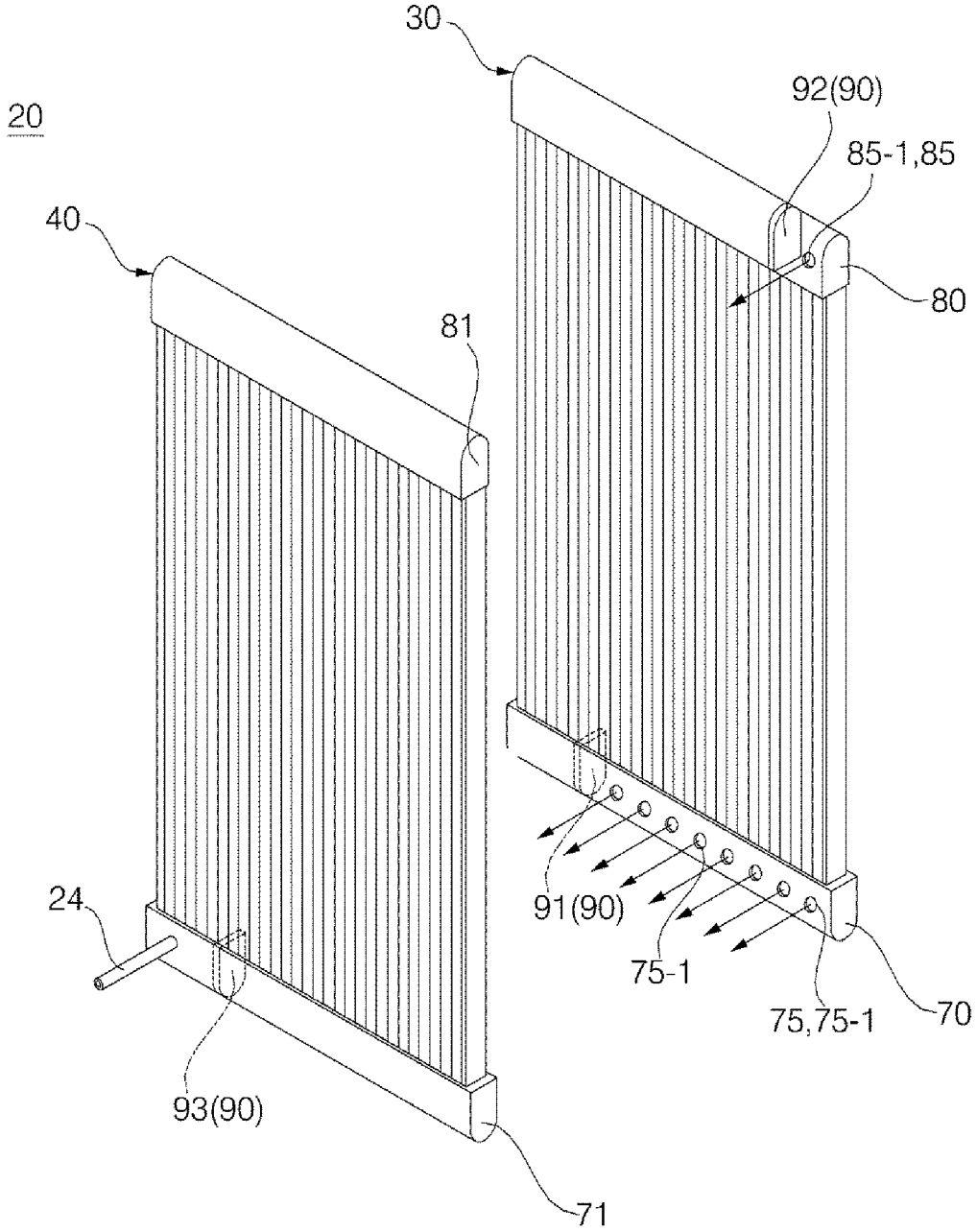
FIG. 4 is an exploded perspective view of the evaporation heat exchanger shown in FIG. 3.
Figure 5:
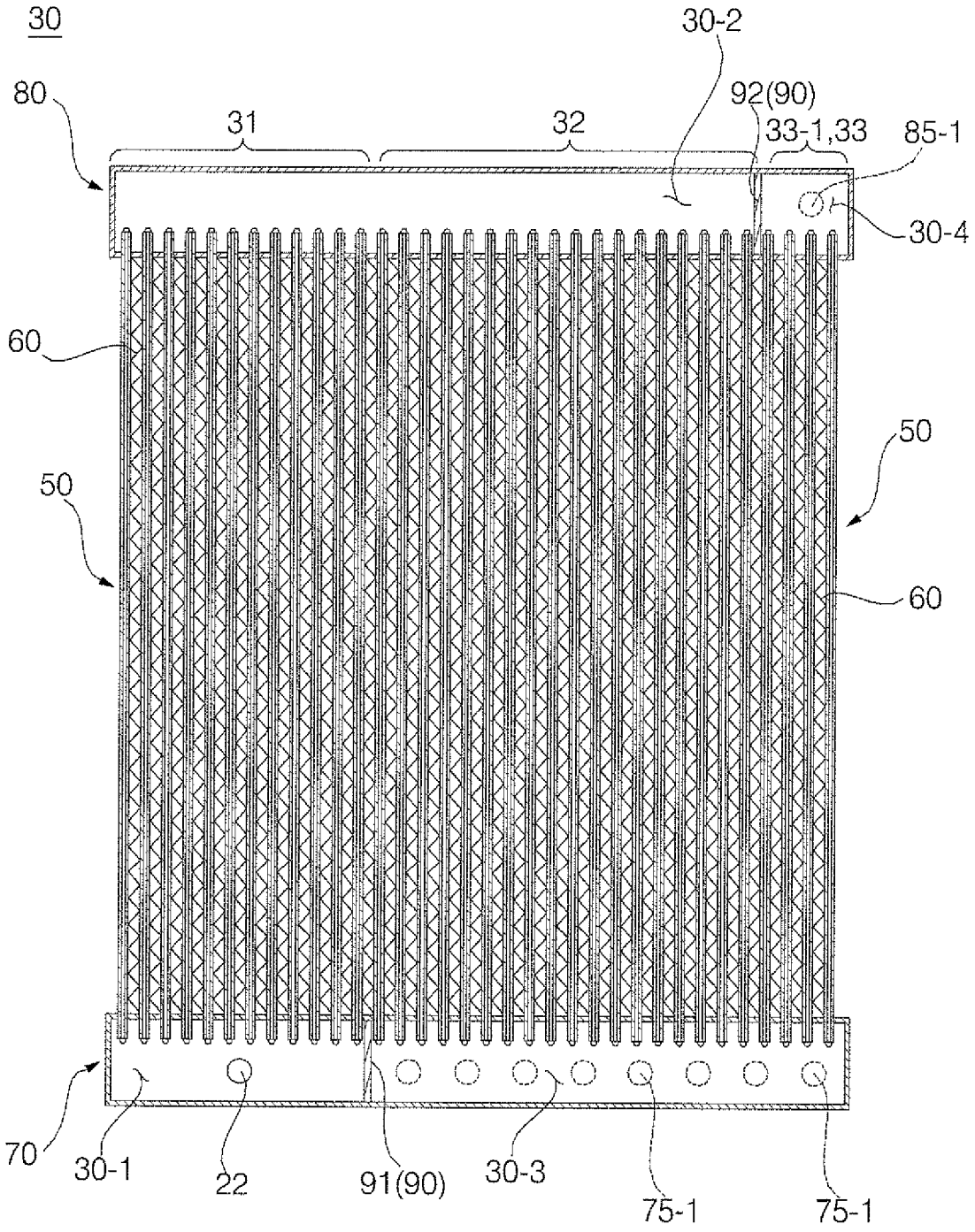
FIG. 5 is a sectional view of a first heat exchange module or first heat exchanger shown in FIG. 3.
Figure 6:
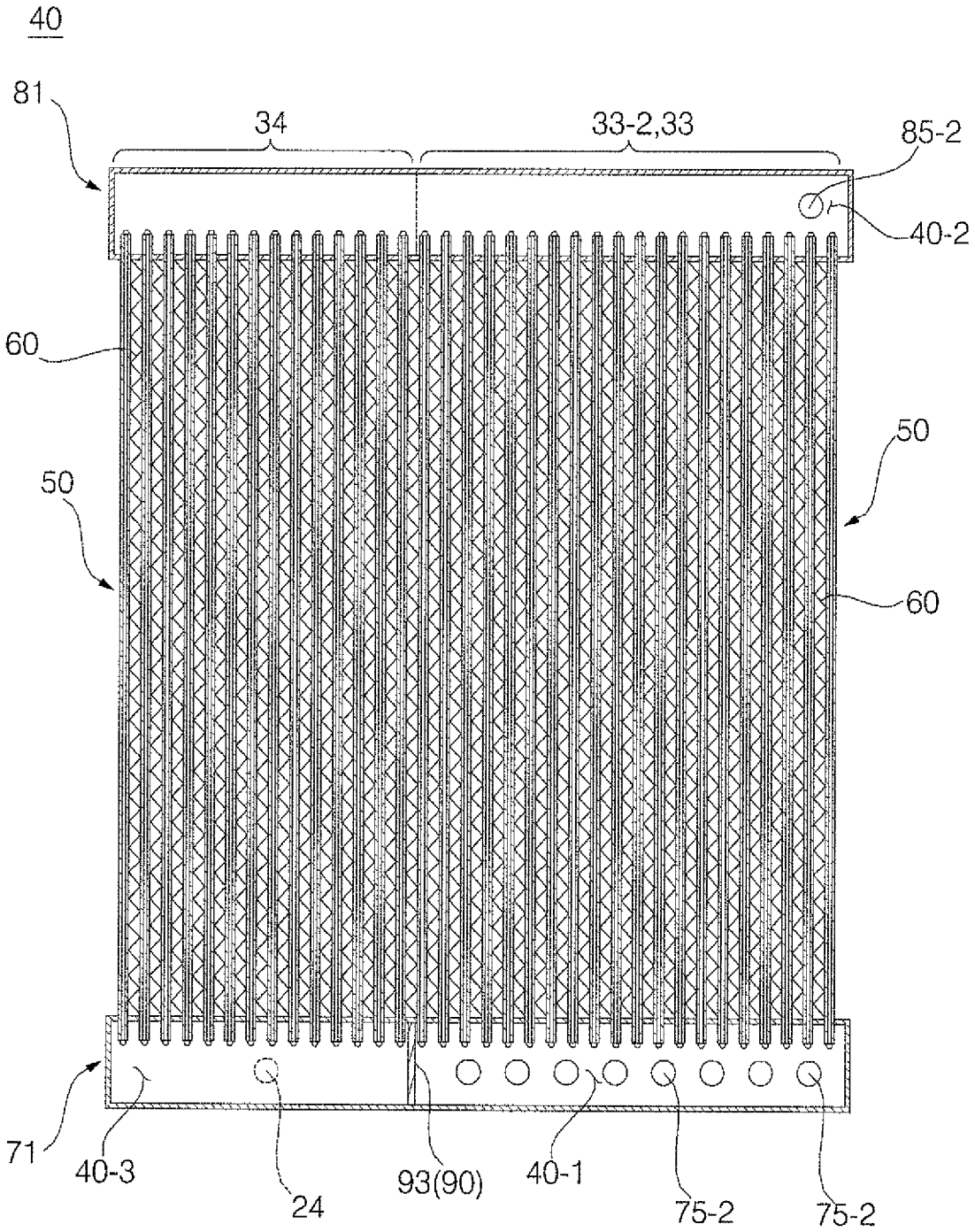
FIG. 6 is a sectional view of a second heat exchange module or second heat exchanger shown in FIG. 3.
Figure 7:
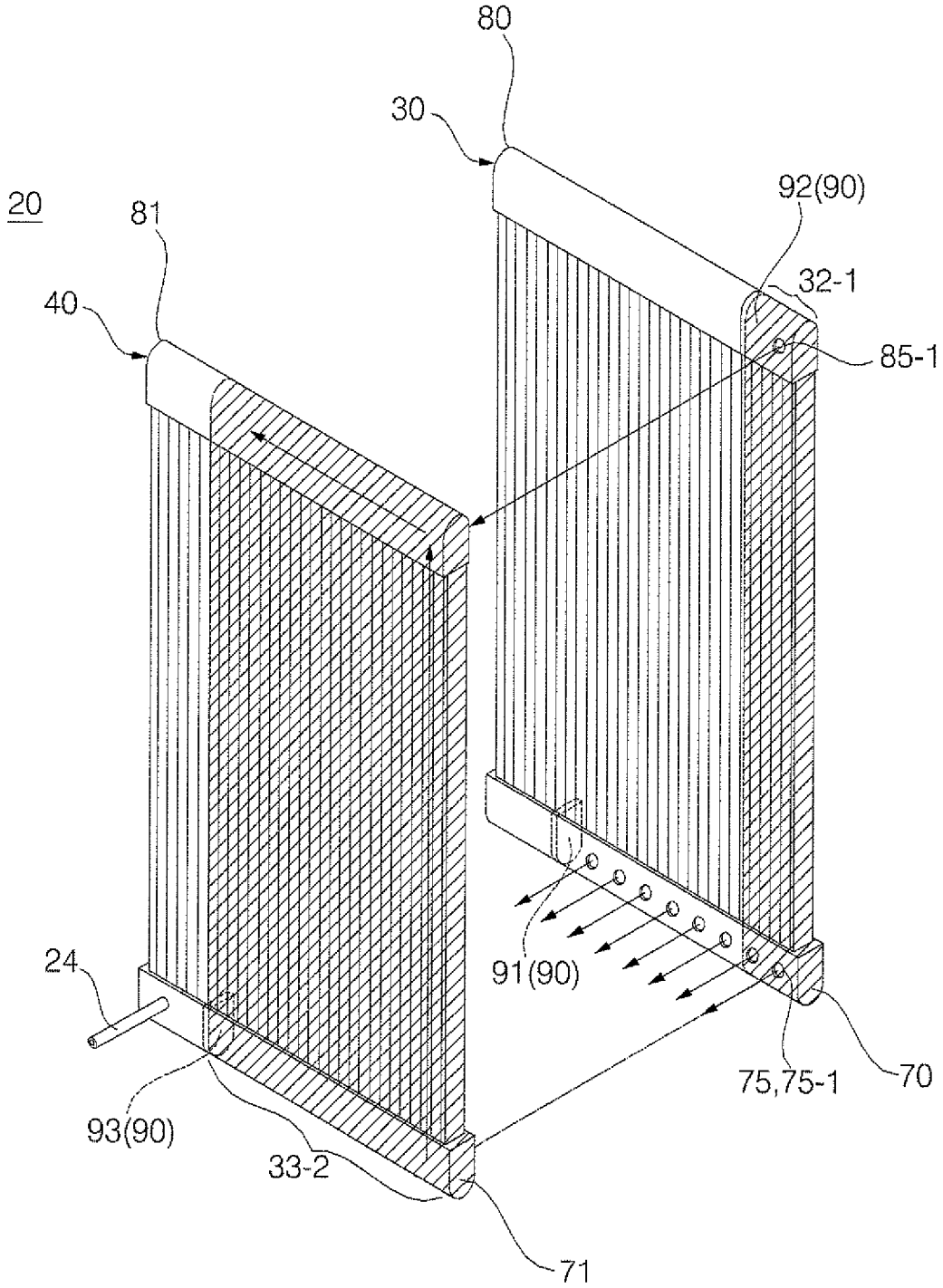
FIG. 7 is a view illustrating a third path of the evaporation heat exchanger shown in FIG. 4.

A microchannel type heat exchanger according to an embodiment will be described with reference to FIGS. 2 to 7.

An air conditioner may include a compressor 10 that compresses a refrigerant, a condensation heat exchanger 26 that condenses the refrigerant from the compressor 10, an expansion device 23 that expands the liquid refrigerant condensed by the condensation heat exchanger 26, and an evaporation heat exchanger 20 that evaporates the refrigerant expanded by the expansion device 23. An electronic expansion valve (EEC), a bi-flow valve, or a capillary tube may be used as the expansion device 23. The air conditioner may further includes a condensation blowing fan 11 to blow air to the condensation heat exchanger 26 and an evaporation blowing fan 12 to blow air to the evaporation heat exchanger 20.

An accumulator (not shown) may be disposed or provided between the evaporation heat exchanger 20 and the compressor 10. The accumulator may store a liquid refrigerant and supply a gaseous refrigerant to the compressor 10.

The evaporation heat exchanger 20 may be a microchannel type heat exchanger. Further, the evaporation heat exchanger 20 may be made of an aluminum material. Furthermore, the evaporation heat exchanger 20 may be configured to have a two-row structure in which two heat exchange modules or heat exchangers may be stacked. The evaporation heat exchanger 20 may be configured to have a dual path structure in which two refrigerant channels may be provided.

The evaporation heat exchanger 20 may include a first heat exchange module or first heat exchanger 30 and a second heat exchange module or second heat exchanger 40, which may be stacked. The first heat exchanger 30 and the second heat exchanger 40 may be disposed or provided so as to stand erect. In the first heat exchanger 30 and the second heat exchanger 40, the refrigerant may flow upward and downward.

The refrigerant may flow from the first heat exchanger 30 to the second heat exchanger 40. When the refrigerant flows from the first heat exchanger 30 to the second heat exchanger 40, the refrigerant may flow through the dual path structure.

The first heat exchanger 30 and the second exchanger module 40 may have similar structures. Therefore, the following description will be given based on the first heat exchanger 30.

The first heat exchanger 30 may include a plurality of flat tubes 50 having a plurality of channels defined therein, fins 60 connected between the respective flat tubes 50 to conduct heat, a first lower header 70 coupled to one or a first side of a stack of the flat tubes 50 so as to communicate with the one or first side of the stack of the flat tubes 50 such that the refrigerant flows in the first lower header 70, a first upper header 80 coupled to the other or a second side of the stack of the flat tubes 50 so as to communicate with the other or second side of the stack of the flat tubes 50 such that the refrigerant flows in the first upper header 80, and a baffle 90 disposed or provided in at least one selected from between the first lower header 70 or the first upper header 80 to partition an interior of the at least one selected from between the first lower header 70 or the first upper header 80 to block the flow of the refrigerant.

The second heat exchanger 40 may include a plurality of flat tubes 50 having a plurality of channels defined therein, fins 60 connected between the respective flat tubes 50 to conduct heat, a second lower header 71 coupled to one or a first side of a stack of the flat tubes 50 so as to communicate with the one or first side of the stack of the flat tubes 50 such that the refrigerant flows in the second lower header 71, a second upper header 81 coupled to the other or a second side of the stack of the flat tubes 50 so as to communicate with the other or second side of the stack of the flat tubes 50 such that the refrigerant flows in the second upper header 81, and a baffle 90 disposed or provided in at least one selected from between the second lower header 71 or the second upper header 81 to partition an interior of the at least one selected from between the second lower header 71 or the second upper header 81 to block the flow of the refrigerant.

Each of the flat tubes 50 may be made of a metal material. In this embodiment, each of the flat tubes 50 may be made of an aluminum material. Each of the fins 60, which may conduct heat, may be made of an aluminum material. Each of the first lower header 70 and the first upper header 80 may be also made of an aluminum material. Alternatively, the above components of the first heat exchanger 30 may be made of other metal materials, such as copper.

A plurality of channels may be defined in the flat tubes 50. The channels may extend in the flat tubes 50 in a longitudinal direction. The flat tubes 50 may be disposed or provided vertically, and the refrigerant may flow upward and downward.

The flat tubes 50 may be stacked in a lateral direction. An upper side of the stack of the flat tubes 50 may be inserted into the first upper header 80 so as to communicate with the interior of the first upper header 80. A lower side of the stack of the flat tubes 50 may be inserted into the first lower header 70 so as to communicate with the interior of the first lower header 70.

Each of the fins 60 may be made of a metal material. The fins 60 may conduct heat. The fins 60 may be made of a same material as the flat tubes 50. In this embodiment, each of the fins 60 may be made of an aluminum material.

Each of the fins 60 may be disposed or provided so as to contact two flat tubes 50. Each of the fins 60 may be disposed or provided between two flat tubes 50. Each of the fins 60 may be bent. Each of the fins 60 may be connected between two flat tubes 50 which are stacked in the lateral direction to conduct heat.

The baffle 90 may be provided to change a direction in which the refrigerant flows. The refrigerant on a left or first lateral side of the baffle 90 and the refrigerant on a right or second lateral side of the baffle 90 may flow in opposite directions.

Four paths may be defined in the evaporation heat exchanger 20 by the baffles 90 disposed or provided in the first heat exchanger 30 and the second heat exchanger 40. A first path 31, a second path 32, and a first portion of a third path 33 may be defined in the first heat exchanger 30. A remaining or second portion of the third path 33 and a fourth path 34 may be defined in the second heat exchanger 40.

In this embodiment, the first portion of the third path 33 defined in the first heat exchanger 30 may be referred to as a 3-1 path 33-1, and the remaining or second portion of the third path 33 defined in the second heat exchanger 40 may be referred to as a 3-2 path 33-2. Each of the paths may include a bundle of flat tubes 50. The refrigerant may flow in a same direction in each of the paths.

Directions in which the refrigerant flows in the respective paths may be changed by the upper headers 80 and 81 or the lower headers 70 and 71. The baffles 90, which change the directions in which the refrigerant flows, may be disposed or provided in the upper headers 80 and 81 or the lower headers 70 and 71.

In this embodiment, an introduction pipe 22 may be connected to the first path 31, and a discharge pipe 24 may be connected to the fourth path 34.

The baffle 90 disposed or provided in the first heat exchanger 30 may include a first baffle 91 to partition the first path 31 and the second path 32 from each other, and a second baffle 92 to partition the second path 32 and the 3-1 path 33-1 from each other. The baffle 90 disposed or provided in the second heat exchanger 40 may include a third baffle 93 to partition the 3-2 path 33-2 and the fourth path 34 from each other.

In the 3-1 path 33-1 and the 3-2 path 33-2, the refrigerant may flow in the same direction, even though the 3-1 path 33-1 and the 3-2 path 33-2 are disposed or provided in different heat exchange modules or heat exchangers.

The first baffle 91 and the second baffle 92 may be disposed or provided in the first heat exchanger 30. The third baffle 93 may be disposed or provided in the second heat exchanger 40. In this embodiment, the first baffle 91 may be disposed or provided in the first lower header 70, and the second baffle 92 may be disposed or provided in the first upper header 80. In this embodiment, the third baffle 93 may be disposed or provided in the second lower header 71.

The introduction pipe 22 may be located at the first lower header 70 of the first path 31. The discharge pipe 24 may be located at the second lower header 71 of the fourth path 34. In a case in which positions of the introduction pipe 22 and the discharge pipe 24 are changed, positions of the baffles 90 may also be changed.

With this embodiment, the third path 33 may include or pass through a plurality of heat exchange modules or heat exchangers (in this embodiment, the first heat exchanger 30 and the second heat exchanger 40). The interior of the first lower header 70 is partitioned into a 1-1 space 30-1 and a 1-3 space 30-3 by the first baffle 91. The interior of the first upper header 80 is partitioned into a 1-2 space 30-2 and a 1-4 space 30-4 by the second baffle 92. The interior of the second lower header 71 is partitioned into a 2-1 space 40-1 and a 2-3 space 40-3 by the third baffle 93.

No baffle is disposed or provided in the second upper header 81. The interior of the second upper header 81 is defined as a 2-2 space 40-2.

The introduction pipe 22 may be connected to the 1-1 space 30-1. The discharge pipe 24 may be connected to the 2-3 space 40-3.

In this embodiment, the first heat exchanger 30 and the second heat exchanger 40 may be provided with lower holes 75, by which the first lower header 70 and the second lower header 71 may be connected to each other such that the refrigerant may flow between the stacked heat exchange modules or heat exchangers. The refrigerant may flow from one of the stacked heat exchange modules or heat exchangers to the other of the stacked heat exchange modules or heat exchangers through the lower holes 75.

Unlike this embodiment, pipes (not shown) may be connected to the lower holes 75 such that the first lower header 70 and the second lower header 71 may be connected to each other by the pipes.

In this embodiment, the 1-3 space 30-3 and the 2-1 space 40-1 may be connected to each other through the lower holes 75. The lower hole 75 formed in the first heat exchanger 30 may be defined as a first lower hole 75-1, and the lower hole 75 formed in the second heat exchanger 40 may be defined as a second lower hole 75-2. The second path 32 and the 3-2 path 33-2 may be connected to each other through the first and second lower holes 75-1 and 75-2. A plurality of first lower holes 75-1 may be formed in the first heat exchanger 30 and a plurality of second lower holes 75-2 may be formed in the second heat exchanger 40, such that the refrigerant may smoothly flow from the first heat exchanger 30 to the second heat exchanger 40.

The first heat exchanger 30 and the second heat exchanger 40 may be provided with upper holes 85, through which the first upper header 80 and the second upper header 81 may be connected to each other, such that the refrigerant may smoothly flow from the first heat exchanger 30 to the second heat exchanger 40. The upper hole 85 formed in the first heat exchanger 30 may be defined as a first upper hole 85-1, and the upper hole 85 formed in the second heat exchanger 40 may be defined as a second upper hole 85-2. In this embodiment, the first upper hole 85-1 may be formed in the 1-3 space 30-4, and the second upper hole 85-2 may be formed in the 2-2 space 40-2.

In this embodiment, the refrigerant may flow from the first heat exchanger 30 to the second heat exchanger 40 through the lower holes 75 or the upper holes 85. Alternatively, an additional pipe (not shown) may be provided such that the refrigerant may flow through the additional pipe. For example, the first lower header 70 and the second lower header 71 may be connected to each other through an external pipe (not shown), rather than through the lower holes 75. In addition, the first upper header 80 and the second upper header 81 may be connected to each other through an external pipe (not shown), rather than through the upper holes 85.

In this embodiment, twelve flat tubes 50 may be disposed or provided in the first path 31. Eighteen flat tubes 50 may be disposed or provided in the second path 32. Four flat tubes 50 may be disposed or provided in the 3-1 path 33-1. Twenty flat tubes 50 may be disposed or provided in the 3-2 path 33-2. Fourteen flat tubes 50 may be disposed or provided in the fourth path 34.

The 3-1 path 33-1 and the 3-2 path 33-2 may include or pass through two heat exchangers 30 and 40. The 3-1 path 33-1 and the 3-2 path 33-2 may act as a single path, even though the 3-1 path 33-1 and the 3-2 path 33-2 include or pass through different heat exchangers 30 and 40.

In this embodiment, a number of flat tubes 50 in the second path 32 may be greater than a number of flat tubes 50 in the first path 31, or a capacity of the second path 32 may be greater than a capacity of the first path 31. In addition, a number of flat tubes 50 in the third path 33 may be greater than the number of flat tubes 50 in the second path 32, or a capacity of the third path 33 may be greater than the capacity of the second path 32.

The fourth path 34 may be variously set based on characteristics of the evaporation heat exchanger 20. In this embodiment, a number of flat tubes 50 in the fourth path 34 may be greater than the number of flat tubes 50 in the first path 31, or a capacity of the fourth path 34 may be greater than the capacity of the first path 31. In addition, the number of flat tubes 50 in the fourth path 34 may be less than the number of flat tubes 50 in the second path 32, or the capacity of the fourth path 34 may be less than the capacity of the second path 32.

The numbers of flat tubes 50 in the paths 31, 32, and 33 or the capacities of the paths 31, 32, and 33 may be increased in order to reduce a loss of pressure of the refrigerant. As the first heat exchanger 30 and the second heat exchanger 40 operate as the evaporation heat exchanger 20, the refrigerant may be evaporated in the flat tubes 50. When a liquid refrigerant is evaporated and becomes a gaseous refrigerant, a specific volume of the refrigerant may be increased. As an amount of refrigerant which is evaporated is gradually increased as the refrigerant flows through the first path 31, the second path 32, and the third path 33, a pressure of the refrigerant may be lost or reduced. In order to reduce the loss of pressure of the refrigerant, therefore, the capacities of the paths 31, 32, and 33 may be gradually increased.

In a case in which the numbers of flat tubes in the respective paths are the same or in a case in which the capacities of the respective paths are the same, a dryness of the refrigerant is high in the path on the discharge side, with a result that the pressure of the refrigerant is greatly lost or reduced. In a case in which the loss of pressure of the refrigerant is reduced in the respective paths, as in this embodiment, a heat exchange performance of the evaporation heat exchanger 20 may be improved.

The capacities of the first path 31 and the second path 32 may be less than about 50% of a capacity of the evaporation heat exchanger 20. The capacity of the third path 33 may be about 30% to 50% of the capacity of the evaporation heat exchanger 20. The third path 33 may be distributed to the first heat exchanger 30 and the second heat exchanger 40.

The refrigerant may flow in the evaporation heat exchanger 20 as follows.

The refrigerant, supplied through the introduction pipe 22, may flow along the first path 31. The refrigerant, supplied through the introduction pipe 22, may flow from the 1-1 space 30-1 to the 1-2 space 30-2. The refrigerant, introduced into the 1-2 space 30-2, may flow from the 1-2 space 30-2 to the 1-3 space 30-3 via the second path 32.

The refrigerant, introduced into the 1-3 space 30-3, may flow along the third path 33. The third path 33 may be divided into the 3-1 path 33-1 and the 3-2 path 33-2. The refrigerant in the 1-3 space 30-3 may be distributed into the 3-1 path 33-1 and the 3-2 path 33-2, and then flow along the 3-1 path 33-1 and the 3-2 path 33-2.

A portion of the refrigerant in the 1-3 space 30-3 may flow to the 1-4 space 30-4 via the 3-1 path 33-1. The refrigerant in the 1-4 space 30-4 may flow to the 2-2 space 40-2 through the upper holes 85. The refrigerant, introduced into the 2-2 space 40-2 through the upper holes 85, may flow horizontally along the 2-2 space 40-2.

The remaining portion of the refrigerant in the 1-3 space 30-3 may flow to the 2-1 space 40-1 through the lower holes 75. The refrigerant in the 2-1 space 40-1 may flow to the 2-2 space 40-2 via the 3-2 path 33-2. That is, the refrigerant in the second path 32 may flow from the 1-3 space 30-3 to the 2-2 space 40-2 via the third path 33.

The refrigerant, gathered in the 2-2 space 40-2, may flow along the 2-2 space 40-2 and then flow to the fourth path 34. After flowing along the fourth path 34, the refrigerant may be discharged from the evaporation heat exchanger 20 through the discharge pipe 24.

In this embodiment, the refrigerant, having passed through the second path 32, may flow along the 3-1 path 33-1, which is defined in the first heat exchanger 30, and the 3-2 path 33-2, which is defined in the second heat exchanger 40, and then be gathered in the 2-2 space 40-2. In the third path 33, the refrigerant may flow in the same direction, even though the third path 33 is distributed to different heat exchangers 30 and 40. Alternatively, the refrigerant flows upward in the third path 33. Unlike this embodiment, the refrigerant may flow downward in the third path 33.

The upper holes 85 and the lower holes 75 may be provided such that the refrigerant may flow in the same direction in the 3-1 path 33-1 and the 3-2 path 33-2, which are separated from each other, and then be gathered. In this embodiment, the refrigerant flows in the same direction, even though the two paths 33-1 and 33-2, which form the third path 33, are distributed to different heat exchangers 30 and 40. Consequently, the 3-1 path 33-1 and the 3-2 path 33-2 act as a single path.

In this embodiment, the capacity of the third path 33 may be greater than the capacities of the other paths, whereby it is possible to reduce the loss of pressure of the refrigerant.

As is apparent from the above description, the heat exchanger according to embodiments disclosed herein has at least the following advantages.

First, numbers of flat tubes in the first path, the second path, and the third path may be gradually increased, whereby it is possible to reduce a loss of pressure of the refrigerant when the heat exchanger is used as an evaporator. Second, a capacity of the third path may be greater than capacities of the other paths, whereby it is possible to reduce the loss of pressure of the refrigerant. Third, two path or portions parts of the third path act as a single path in two separate heat exchanger.

Fourth, the third path may be distributed to two heat exchange modules or heat exchangers, whereby it is possible to adjust a distribution ratio of flat tubes. Fifth, two path parts or portions of the third path act as a single path even though the two path parts or portions of the third path are distributed to different heat exchange modules or heat exchangers, whereby it is possible to reduce the loss of pressure of the refrigerant, which may be caused when the refrigerant is evaporated.

Embodiments disclosed herein provide a heat exchanger configured to have a structure in which it is possible to reduce a loss of pressure of a refrigerant when the heat exchanger is used as an evaporator. Embodiments disclosed herein further provide a heat exchanger configured to have a structure in which paths distributed to stacked heat exchange modules or heat exchangers act as a single path. Additionally, embodiments disclosed herein provide a heat exchanger configured to have a structure in which a distribution ratio of paths may be adjusted in order to reduce a loss of pressure of a refrigerant when the heat exchanger is used as an evaporator.

Embodiments disclosed herein provide a microchannel type heat exchanger that may include a first heat exchange module or first heat exchanger and a second heat exchange module or second heat exchanger, in which a plurality of flat tube may be disposed or provided, the heat exchanger including a first path defined in a portion or a first portion of the flat tubes disposed or provided in the first heat exchange module, the first path being configured such that a refrigerant may flow in one or a first direction, a second path defined in another or a second portion of the flat tubes disposed or provided in the first heat exchange module, the first path being configured such that the refrigerant, supplied from the first path, may flow in a direction or second direction opposite to the direction in which the refrigerant flows in the first path, a third path defined in a remaining or third portion of the flat tubes disposed or provided in the first heat exchange module and a portion of the flat tubes disposed or provided in the second heat exchange module, the third path being configured such that the refrigerant, supplied from the second path, may flow in a direction or third direction opposite to the direction in which the refrigerant may flow in the second path, and a fourth path defined in a remaining portion of the flat tubes disposed or provided in the second heat exchange module, the fourth path being configured such that the refrigerant, supplied from the third path, may flow in a direction or fourth direction opposite to the direction in which the refrigerant flows in the third path.

A number of flat tubes disposed or provided in the second path may be greater than a number of flat tubes disposed or provided in the first path, or a capacity of the second path may be greater than a capacity of the first path. A number of flat tubes disposed or provided in the third path may be greater than the number of flat tubes disposed or provided in the second path, or a capacity of the third path may be greater than the capacity of the second path.

A number of flat tubes disposed or provided in the fourth path may be greater than the number of flat tubes disposed or provided in the first path, or a capacity of the fourth path may be greater than the capacity of the first path. The number of flat tubes disposed or provided in the fourth path may be greater than the number of flat tubes disposed or provided in the first path, or the capacity of the fourth path may be greater than the capacity of the first path, and the number of flat tubes disposed or provided in the fourth path may be less than the number of flat tubes disposed in the second path, or the capacity of the fourth path may be less than the capacity of the second path. The number of flat tubes disposed or provided in the third path may be about 30% to 50% of a sum of the numbers of flat tubes disposed or provided in all the paths, or the capacity of the third path may be about 30% to 50% of a sum of capacities of all the paths.

The third path may include a 3-1 path defined in the first heat exchange module and a 3-2 path defined in the second heat exchange module. The refrigerant passing through the 3-1 path and the 3-2 path may flow in a direction opposite to the direction in which the refrigerant flows in the second path.

The number of flat tubes disposed or provided in the 3-2 path may be about 50% or more of a number of flat tubes disposed or provided in the second heat exchange module, or a capacity of the 3-2 path may be about 50% or more of a capacity of the second heat exchange module.

The first heat exchange module may include the flat tubes, in which the refrigerant flows, fins connected between the respective flat tubes to conduct heat, a first lower header coupled to one or a first side of a stack of the flat tubes so as to communicate with the one side of the stack of the flat tubes such that the refrigerant flows in the first lower header, a first upper header coupled to the other or a second side of the stack of the flat tubes so as to communicate with the other side of the stack of the flat tubes such that the refrigerant flows in the first upper header, a first baffle disposed or provided in the first lower header to partition an interior of the first lower header to define the first path and the second path, and a second baffle disposed or provided in the first upper header to partition an interior of the first upper header to define the second path and a portion of the third path. The second heat exchange module may include the flat tubes, in which the refrigerant flows, fins connected between the respective flat tubes to conduct heat, a second lower header coupled to one or a first side of a stack of the flat tubes so as to communicate with the one side of the stack of the flat tubes such that the refrigerant flows in the second lower header, a second upper header coupled to the other or a second side of the stack of the flat tubes so as to communicate with the other side of the stack of the flat tubes such that the refrigerant flows in the second upper header, and a third baffle disposed or provided in the second lower header to partition an interior of the second lower header to define a remaining portion of the third path and the fourth path.

An introduction pipe, through which the refrigerant may be supplied, may be connected to the first lower header of the first path, and a discharge pipe, through which the refrigerant may be discharged, may be connected to the second lower header of the fourth path.

The third path may include a 3-1 path defined in the first heat exchange module and a 3-2 path defined in the second heat exchange module. The 3-1 path may be defined in the first heat exchange module by the second baffle, and the 3-2 path may be defined in the second heat exchange module by the third baffle.

The first upper header, in which the 3-1 path may be defined, may be provided with a first upper hole. The second upper header, in which the 3-2 path may be defined, may be provided with a second upper hole. A portion of the refrigerant in the third path may flow to the second upper header through the first upper hole and the second upper hole.

The first lower header, in which the 3-1 path may be defined, may be provided with a first lower hole. The second lower header, in which the 3-2 path may be defined, may be provided with a second lower hole. A portion of the refrigerant in the third path may flow to the second lower header through the first lower hole and the second lower hole. The first upper header, in which the 3-1 path may be defined, may be provided with a first upper hole. The second upper header, in which the 3-2 path may be defined, may be provided with a second upper hole. A portion of the refrigerant in the third path may flow to the second upper header through the first upper hole and the second upper hole. In addition, the first lower header, in which the 3-1 path may be defined, may be provided with a first lower hole. The second lower header, in which the 3-2 path may be defined, may be provided with a second lower hole. A remaining portion of the refrigerant in the third path may flow to the second lower header through the first lower hole and the second lower hole. The first lower hole may include a plurality of first lower holes, and the second lower hole may include a plurality of second lower holes.

The number of flat tubes disposed or provided in the second path may be greater than the number of flat tubes disposed or provided in the first path, or the capacity of the second path may be greater than the capacity of the first path, and the number of flat tubes disposed or provided in the third path may be greater than the number of flat tubes disposed or provided in the second path, or the capacity of the third path may be greater than the capacity of the second path. The number of flat tubes disposed or provided in the fourth path may be greater than the number of flat tubes disposed or provided in the first path, or the capacity of the fourth path may be greater than the capacity of the first path.

The number of flat tubes disposed or provided in the fourth path may be greater than the number of flat tubes disposed or provided in the first path, or the capacity of the fourth path may be greater than the capacity of the first path, and the number of flat tubes disposed or provided in the fourth path may be less than the number of flat tubes disposed or provided in the second path, or the capacity of the fourth path may be less than the capacity of the second path.

The number of flat tubes disposed or provided in the third path may be about 30% to 50% of a sum of the numbers of flat tubes disposed or provided in all the paths, or the capacity of the third path may be about 30% to 50% of a sum of capacities of all the paths.

It will be apparent that, although the embodiments have been described above with reference to the accompanying drawings, the embodiments are not limited to the above-described specific embodiments, and therefore various modifications and variations can be made by those skilled in the art without departing from the gist of the appended claims. Thus, it is intended that the modifications and variations should not be understood independently of the technical spirit or prospect. The above embodiments are therefore to be construed in all aspects as illustrative and not restrictive.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A microchannel type heat exchanger including a first heat exchanger and a second heat exchanger, in which a plurality of flat tube is provided, the microchannel type heat exchanger comprising:

the first heat exchanger which includes:

the plurality of flat tubes, in which the refrigerant flows;

fins connected between the respective flat tubes to conduct heat;

a first lower header coupled to a first side of a stack of the plurality of flat tubes so as to communicate with the first side of the stack of the plurality of flat tubes such that the refrigerant flows in the first lower header;

a first upper header coupled to a second side of the stack of the plurality of flat tubes so as to communicate with the second side of the stack of the plurality of flat tubes such that the refrigerant flows in the first upper header;

a first baffle provided in the first lower header to partition an interior of the first lower header to define the first path and the second path; and a second baffle provided in the first upper header to partition an interior of the first upper header to define the second path and a portion of the third path; and the second heat exchanger which includes:

the plurality of flat tubes, in which the refrigerant flows;

fins connected between the respective flat tubes to conduct heat;

a second lower header coupled to a first side of a stack of the plurality of flat tubes so as to communicate with the first side of the stack of the plurality of flat tubes such that the refrigerant flows in the second lower header;

a second upper header coupled to a second side of the stack of the plurality of flat tubes so as to communicate with the second side of the stack of the flat tubes such that the refrigerant flows in the second upper header; and a third baffle provided in the second lower header to partition an interior of the second lower header to define the remaining portion of the third path and the fourth path, wherein the first path is defined in a first portion of the plurality of flat tubes provided in the first heat exchanger, the first path being configured such that the refrigerant flows in a first direction;

wherein the second path is defined in a second portion of the plurality of flat tubes provided in the first heat exchanger, the second path being configured such that the refrigerant, supplied from the first path, flows in a second direction opposite to the first direction;

wherein the third path is defined in a remaining portion of the plurality of flat tubes provided in the first heat exchanger and a portion of the plurality of flat tubes provided in the second heat exchanger, the third path being configured such that the refrigerant, supplied from the second path, flows in a third direction opposite to the second direction;

wherein the fourth path is defined in a remaining portion of the plurality of flat tubes provided in the second heat exchanger, the fourth path being configured such that the refrigerant, supplied from the third path, flows in a fourth direction opposite to the third direction;

wherein the third path includes a 3-1 path defined in the first heat exchanger and a 3-2 path defined in the second heat exchanger, the 3-1 path is defined in the first heat exchanger by the second baffle, and the 3-2 path is defined in the second heat exchanger by the third baffle;

wherein the 3-1 path and 3-2 path are configured such that the refrigerant, supplied from the first path, flows in the first direction;

wherein the first baffle partitions into a 1-1 space and 1-3 space the interior of the first lower header;

wherein the third baffle partitions into a 2-1 space and 2-3 space the interior of the second lower header;

wherein the second baffle partitions into a 1-2 space and 1-4 space the interior of the first upper header;

wherein the interior of the second upper header forms a 2-2 space;

wherein the first lower header, in which the 3-1 path is defined, is provided with a plurality of first lower holes, the second lower header, in which the 3-2 path is defined, is provided with a plurality of second lower holes, and a portion of the refrigerant in the third path flows to the second lower header through the plurality of first lower holes and the plurality of second lower holes;

wherein the plurality of first lower holes and the plurality of second lower holes are located on a lower side of the flat tubes, and the plurality of first lower holes and the plurality of second lower holes communicate with the 1-3 space and the 2-1 space, wherein the 3-2 path is disposed in the 2-1 space;

wherein the first upper header, in which the 3-1 path is defined, is provided with at least one first upper hole, the second upper header, in which the 3-2 path is defined, is provided with at least one second upper hole, and a portion of the refrigerant in the third path flows to the second upper header through the at least one first upper hole and the at least one second upper hole;

wherein the at least one first upper hole and the at least one second upper hole are located on an upper side of the flat tubes, and the at least one first upper hole and the at least one second upper hole communicate with the 1-4 space and the 2-4-2 space, wherein the 3-1 path is disposed in the 1-4 space;

wherein a number of the plurality of second lower holes is greater than a number of the at least one first upper hole;

wherein a number of flat tubes provided in the 3-2 path is greater than a number of flat tubes provided in the 3-1 path, or a capacity of the 3-2 path is greater than a capacity of the 3-1 path; and wherein the number of flat tubes provided in the 3-1 path is smaller than each of a number of flat tubes provided in the first path and a number of flat tubes provided in the second path, and the number of flat tubes provided in the 3-2 path is 50% or more a number of flat tubes provided in the second heat exchanger, or the capacity of the 3-1 path is less than each of a capacity of the first path and a capacity of the second path, and the capacity of the 3-2 path is 50% or more of a capacity of the second exchanger.

2. The heat exchanger according to claim 1, wherein the number of flat tubes provided in the second path is greater than the number of flat tubes provided in the first path, or the capacity of the second path is greater than the capacity of the first path.

3. The heat exchanger according to claim 2, wherein a number of flat tubes provided in the third path is greater than the number of flat tubes provided in the second path, or a capacity of the third path is greater than the capacity of the second path.

4. The heat exchanger according to claim 3, wherein a number of flat tubes provided in the fourth path is greater than the number of flat tubes provided in the first path, or a capacity of the fourth path is greater than the capacity of the first path.

5. The heat exchanger according to claim 3, wherein a number of flat tubes provided in the fourth path is greater than the number of flat tubes provided in the first path, or a capacity of the fourth path is greater than the capacity of the first path, and the number of flat tubes provided in the fourth path is less than the number of flat tubes provided in the second path, or the capacity of the fourth path is less than the capacity of the second path.

6. The heat exchanger according to claim 1, wherein a number of flat tubes provided in the third path is about 30% to 50% of a sum of numbers of flat tubes provided in all the paths, or a capacity of the third path is about 30% to 50% of a sum of capacities of all the paths.

7. The heat exchanger according to claim 1, wherein an introduction pipe, through which the refrigerant is supplied, is connected to the first lower header of the first path, and a discharge pipe, through which the refrigerant is discharged, is connected to the second lower header of the fourth path.

8. The heat exchanger according to claim 1, wherein the number of flat tubes provided in the second path is greater than the number of flat tubes provided in the first path, or a capacity of the second path is greater than the capacity of the first path, and a number of flat tubes provided in the third path is greater than the number of flat tubes provided in the second path, or a capacity of the third path is greater than the capacity of the second path.

9. The heat exchanger according to claim 8, wherein a number of flat tubes provided in the fourth path is greater than the number of flat tubes provided in the first path, or a capacity of the fourth path is greater than the capacity of the first path.

10. The heat exchanger according to claim 8, wherein a number of flat tubes provided in the fourth path is greater than the number of flat tubes provided in the first path, or a capacity of the fourth path is greater than the capacity of the first path, and the number of flat tubes provided in the fourth path is less than the number of flat tubes provided in the second path, or the capacity of the fourth path is less than the capacity of the second path.

11. The heat exchanger according to claim 1, wherein a number of flat tubes provided in the third path is about 30% to 50% of a sum of numbers of flat tubes provided in all the paths, or a capacity of the third path is about 30% to 50% of a sum of capacities of all the paths.

* * * * *